United States Patent [19]

Sasaki

[11] 4,063,525

[45] Dec. 20, 1977

[54] AUTOMATIC ZIGZAG SEWING MACHINE

[75] Inventor: Toshio Sasaki, Nagoya, Japan

[73] Assignee: Brother Kogyo Kabushiki Kaisha, Nagoya, Japan

[21] Appl. No.: 664,417

[22] Filed: Mar. 5, 1976

[30] Foreign Application Priority Data

Mar. 5, 1975 Japan ..... 50-26777

[51] Int. Cl.[2] ..... D05B 3/02

[52] U.S. Cl. ..... 112/158 A

[58] Field of Search ..... 112/158 A, 158 D, 158 F, 112/158 R

[56] References Cited

U.S. PATENT DOCUMENTS

| | | | |
|---|---|---|---|
| 2,848,963 | 8/1958 | Johnson | 112/158 F |
| 3,043,252 | 7/1962 | Engel | 112/158 A |
| 3,126,849 | 3/1964 | Giesselmann | 112/158 R |
| 3,313,257 | 4/1967 | Hanyu et al. | 112/158 R |
| 3,807,329 | 4/1974 | Daman | 112/158 D |
| 3,871,310 | 3/1975 | Hanyu | 112/158 F |

FOREIGN PATENT DOCUMENTS

| | | | |
|---|---|---|---|
| 839,671 | 6/1960 | United Kingdom | 112/158 |
| 919,973 | 2/1963 | United Kingdom | 112/158 F |

*Primary Examiner*—Werner H. Schroeder
*Assistant Examiner*—Peter Nerbun
*Attorney, Agent, or Firm*—Browdy and Neimark

[57] ABSTRACT

A zigzag sewing machine wherein, when a pattern selecting means is manually operated for selecting a desired stitch pattern, at least one of an amplitude regulator and a feed regulator is automatically set, in accordance with the manual operation of said selecting means, to a certain suitable condition which is previously designed to form a master stitch pattern for each pattern to be selected, and wherein at least one of manually operable knobs which are operatively connected with the two regulators, respectively, is not only automatically set at the same time with the regulator setting, indicating the set condition thereof, but also adjustable to change the set condition within a certain range for forming a modified stitch pattern similar to the master pattern.

12 Claims, 15 Drawing Figures

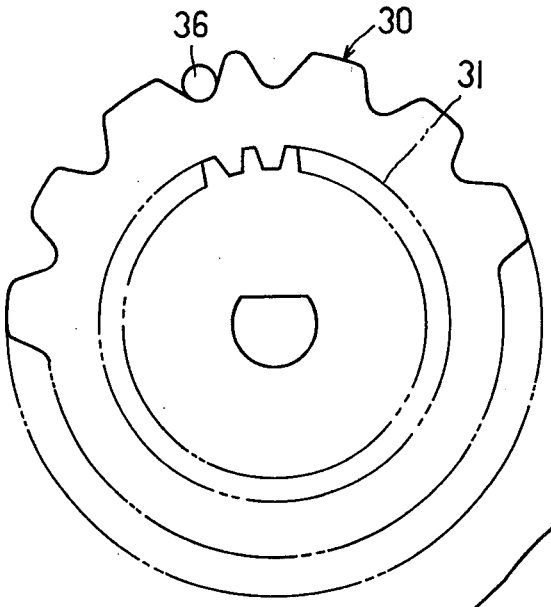
FIG. 7
FIG. 8
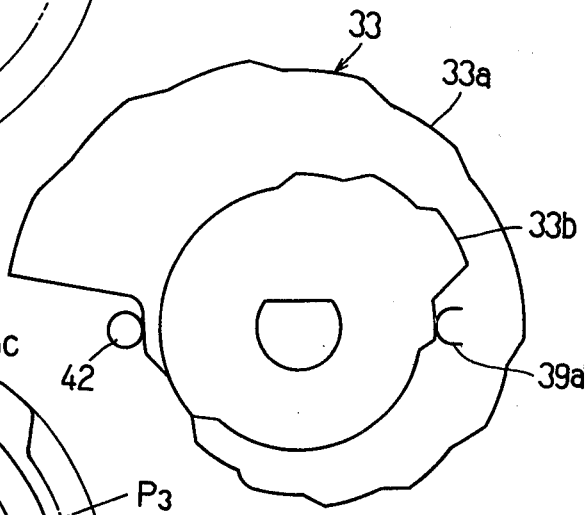
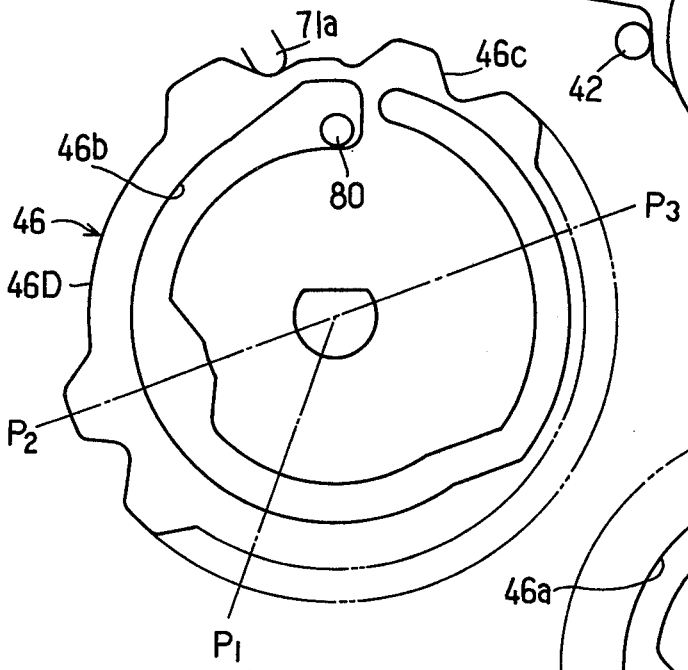
FIG. 9
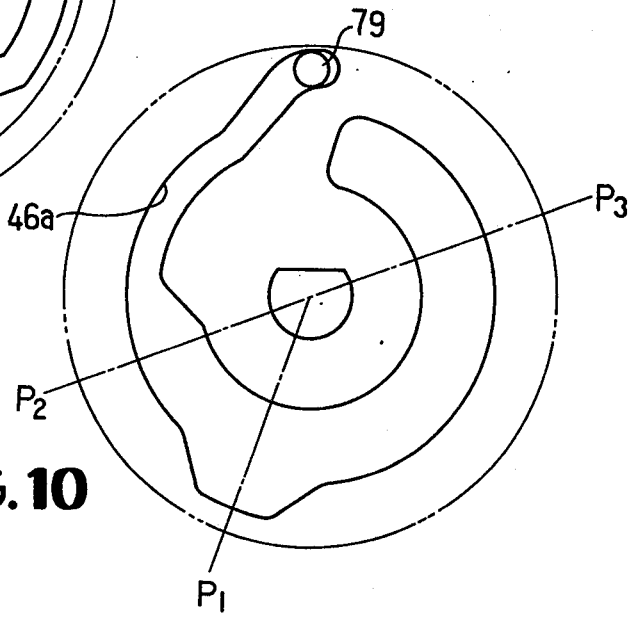
FIG. 10

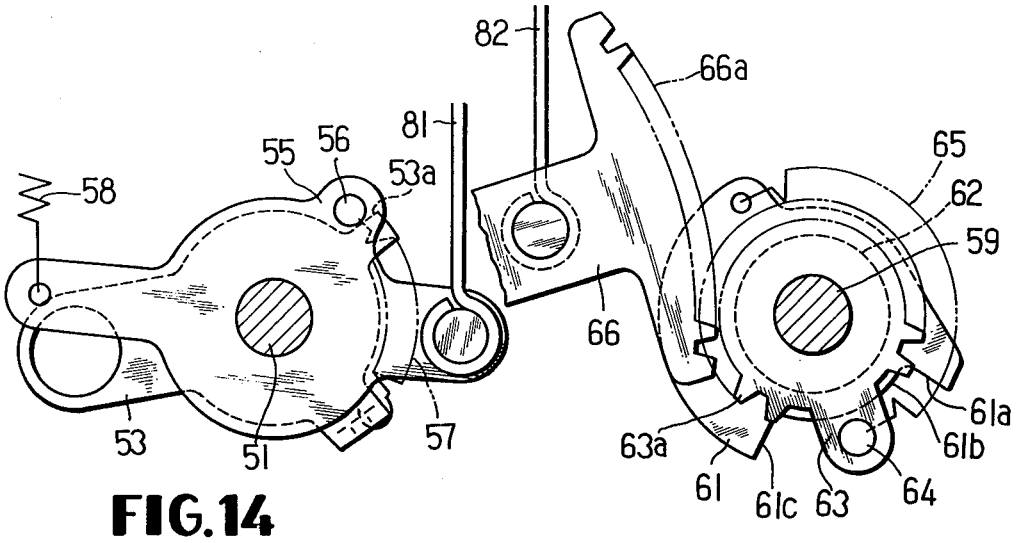
FIG. 14
FIG. 15
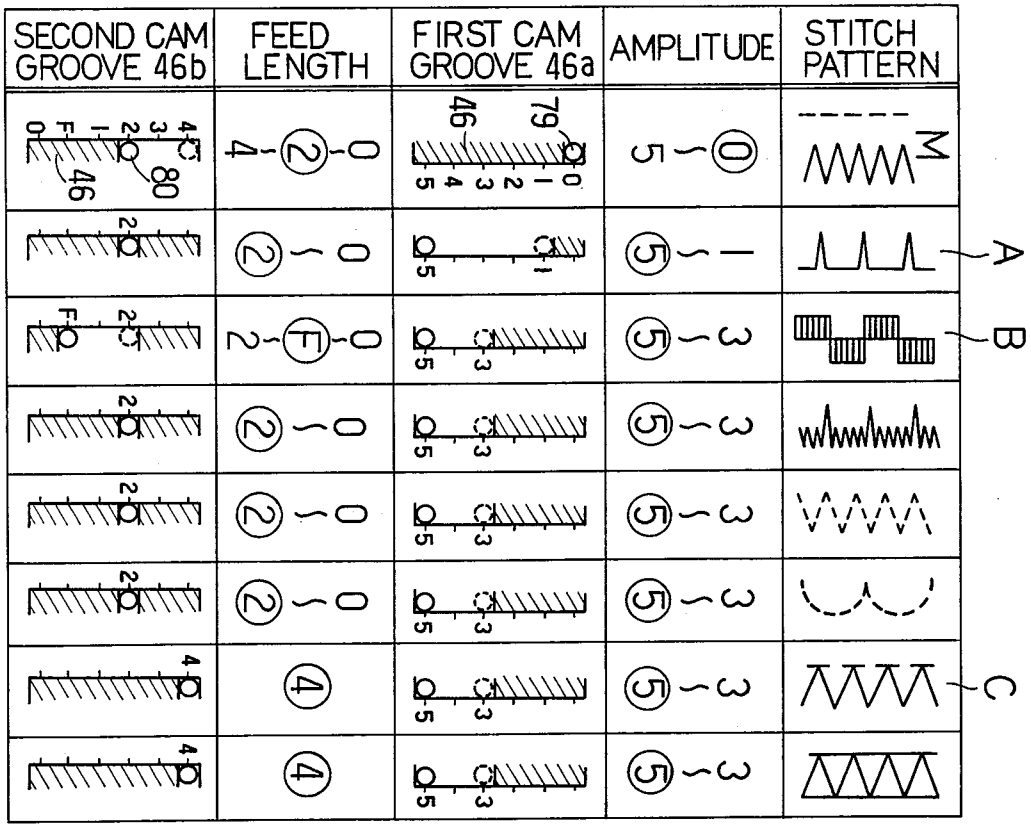

AUTOMATIC ZIGZAG SEWING MACHINE

BACKGROUND OF THE INVENTION

The present invention relates to a zigzag sewing machine having manually operable pattern selecting means for selecting a desired stitch pattern.

In conventional automatic zigzag sewing machines, an operation of the pattern selecting means for selecting a desired stitch pattern to be formed has been necessary at first prior to working of the machine; then, setting of the amplitude regulator and the feed regulator must be performed, in order to determine a zigzag amplitude and a feed amount suitable for forming the selected stitch pattern, with manually operable knobs which are operatively connected to both regulators, respectively.

The amplitude and feed amount suitable for forming the selected stitch pattern are, however, not necessarily constant, but may be variable depending on stitch patterns. The setting of the amplitude regulator and/or feed regulator is cumbersome for sewing machine operators, which often becomes a cause to give an impression to those unskillful in usage of a sewing machine that it is troublesome to handle.

If, besides, a sewing machine is worked when said amplitude regulator or feed regulator is set into an inappropriate condition, it is not merely incapable of forming a stitch pattern of desired shape but also liable to give doubt whether the machine is out of order.

With the object of obviating such shortcomings as much as possible, a type of sewing machine, as stated in the British Pat. No. 919,973 has been built for forming a desired stitch pattern in a predetermined size, wherein representations on the machine frame for displaying each model of such stitch patterns are assorted by colors, and operating positions for regulators to determine the amplitude and feed amount etc. are indicated with those colors. The manually operable knob(s) are operated to the operating position which is indicated with the same color as that of the representation corresponding to the selected stitch pattern. Another type of sewing machine, as stated in the specification and appended drawings of the U.S. Pat. No. 3,871,310, has a ready table indicating operating positions of each manually operable knob suitable to form stitch patterns to be selected.

When, however, the stitch patterns to be selected are in great variety, the indication of such operating positions becomes complex, resulting in embarrassing machine operators contrary to expectation.

In the so-called changeable-cam type sewing machines having no pattern selecting means, still another type of machine is being provided, as stated in the specification and appended drawings of the U.S. Pat. No. 3,807,329, wherein the amplitude regulator and feed regulator, etc. can be, in relation to the inserting operation of a cassette including cams corresponding to the desired stitch pattern into a predetermined position of the machine, automatically set in a suitable condition for the stitch pattern.

In this type of machine, however, cam means for setting the amplitude regulator and feed regulator, etc. must be disposed on a cassette, which necessitates preparing the same number of cassettes as that of stitch patterns. A great deal of time and cost required for preparation of the cams makes this type machine substantially impractical.

In addition, the inconveniences in practice which prevent a machine operator from watching the condition of automatic setting of the machine regulator and feed regulator, etc. and also from changing the setting condition of the regulators by manual operation make the operator skillful in using sewing machines feel unsatisfied.

SUMMARY OF THE INVENTION

The present invention is aimed at a perfect elimination of the above-mentioned drawbacks accompanied by the conventional sewing machines.

In a preferable embodiment in accordance with this invention a cam selecting means for selecting a desired stitch pattern is operatively connected to both the amplitude regulator for determining the width of the zigzag stitches and the feed regulator for determining the length of the stitches; the machine thereby allows not only the amplitude regulator and feed regulator to be automatically set in a suitable condition for forming the selected stitch pattern but also the manually operable knobs operatively connected to each of both regulators shifted to a position corresponding to the condition of automatic setting in order to indicate the condition.

An object of the present invention is, therefore, to provide a zigzag sewing machine easy to handle which permits elimination of at least either one manual operation for the setting of an amplitude regulator or feed regulator in the formation of a desired stitch pattern, and which allows the operator to watch the condition of automatic setting of the regulator.

In an embodiment of this invention the machine is constructed such that the amplitude regulator or feed regulator automatically set into a predetermined condition regarding the selection of a stitch pattern can be appropriately operated with said manually operable knobs into various conditions and thereby capable of forming the selected stitch pattern not only in a predetermined form but also in desired modified forms, similar to conventional sewing machines.

Another object of this invention is, therefore, to provide a zigzag sewing machine wherein not merely a preparation is made for formation of the selected stitch pattern in the predetermined form only by a manual operation of the pattern selecting means but also a preparation is performed for formation of the selected stitch pattern in any desired modified forms, similar to conventional sewing machines, in response to needs, by means of another manual operation.

BRIEF DESCRIPTION OF THE DRAWINGS

FIG. 7 is a view showing the shape of a lift cam seen from the direction X in FIG. 6.

FIG. 8 is likewise a view showing the shape of cam surface of a selector cam.

FIG. 9 is likewise a view showing the shape of the second cam groove and the third cam surface of a controlling cam.

FIG. 10 is likewise a view showing the shape of the first cam groove of the controlling cam.

FIGS. 12 through 14 is each an illustrating view of operation showing the positional relation of different positions of each member shown in FIG. 11.

FIG. 15 is a table for explaining the condition of amplitude, feed and so on set corresponding to the representative stitch patterns to be selected.

DETAILED DESCRIPTION OF THE DRAWINGS

Figures 1, 6:
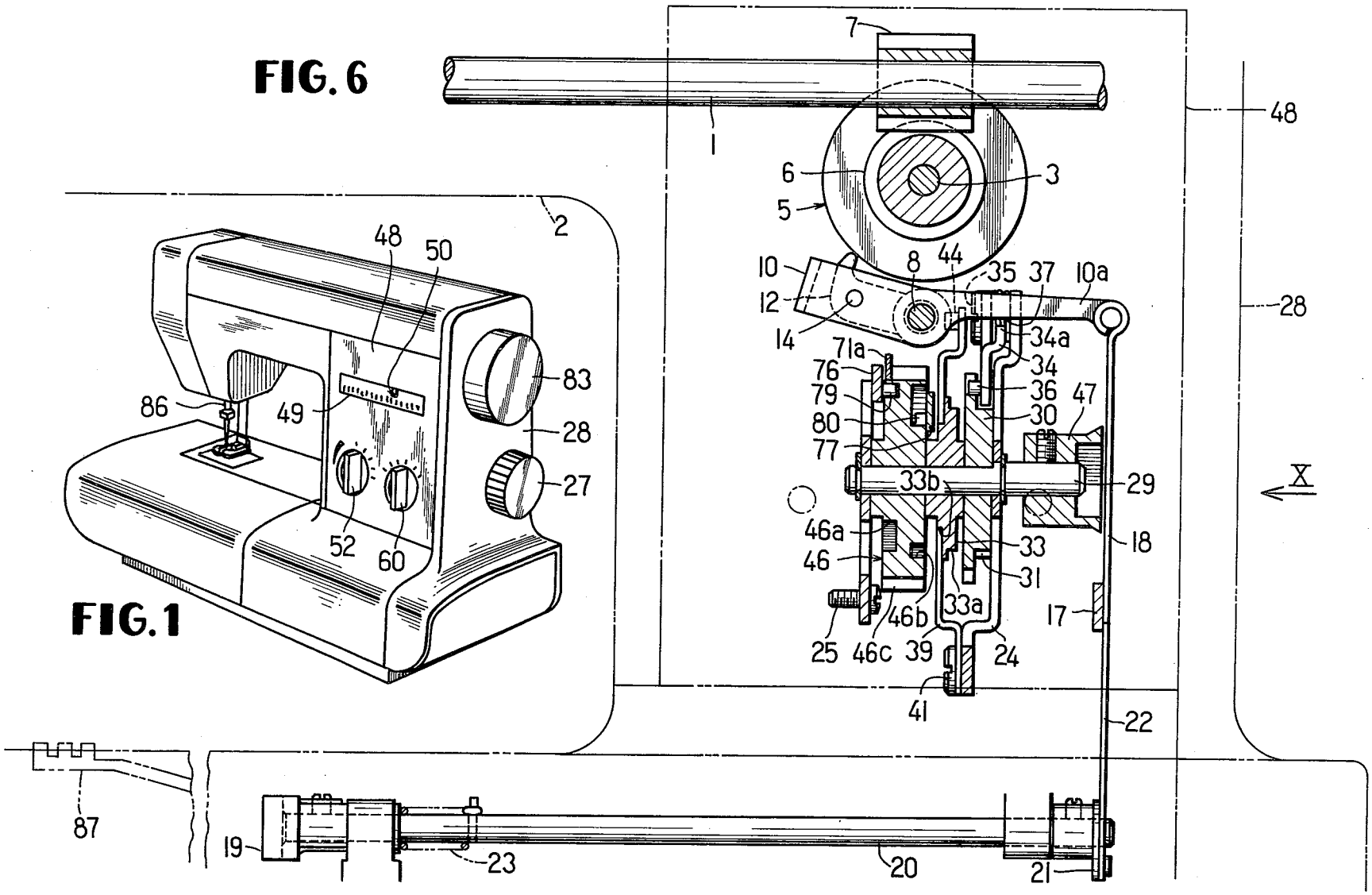
FIG. 1 is a perspective view showing the general view of a sewing machine in accordance with an embodiment of this invention.
FIG. 6 is a vertical cross-sectional view taken substantially along the line VI—VI of FIG. 4.

Referring to the drawings representing an embodiment of this invention, detailed description will be deployed hereinunder.

A main shaft 1 of the sewing machine is carried by the machine frame 2, to which a cam shaft 3 is fixedly fitted. Both a plurality of pattern cams 4 for imparting a lateral movement to a needle bar 86 and a plurality of feed controlling cams 5 for controlling the feed movement of feed dog 87 are integrally carried by said cam shaft 3, along with a gear 6; and both are driven in timed relationship with the main shaft 1, through meshing of a gear 7 secured thereto and said gear 6 in reduced rotation rate. In parallel with said cam shaft 3 is fixedly fitted a stationary shaft 8 to the machine frame 2, on which shaft are oscillably fitted first and second rocker arms 9 and 10 therethrough having a substantially channel shape in section, said arms being immovably mounted in the axial direction. First and second cam followers 11 and 12 are respectively mounted on the stationary shaft 8 with the base portion being passed therethrough such that both are located inside the rocker arms 9, 10; both are, as may be apparent in FIGS. 5 and 6, respectively passed through by connecting shafts 13 and 14 which are secured to the rocker arms 9 and 10 in parallel with said stationary shaft 8; each of those oscillates unitedly with the respective rocker arm 9 and 10 and is movable in the axial direction, and is further capable of selective engagement with any one of the pattern cams 4 and any one of the feed controlling cams 5, respectively, by means of an action of the cam selecting means later described.

Figure 2:
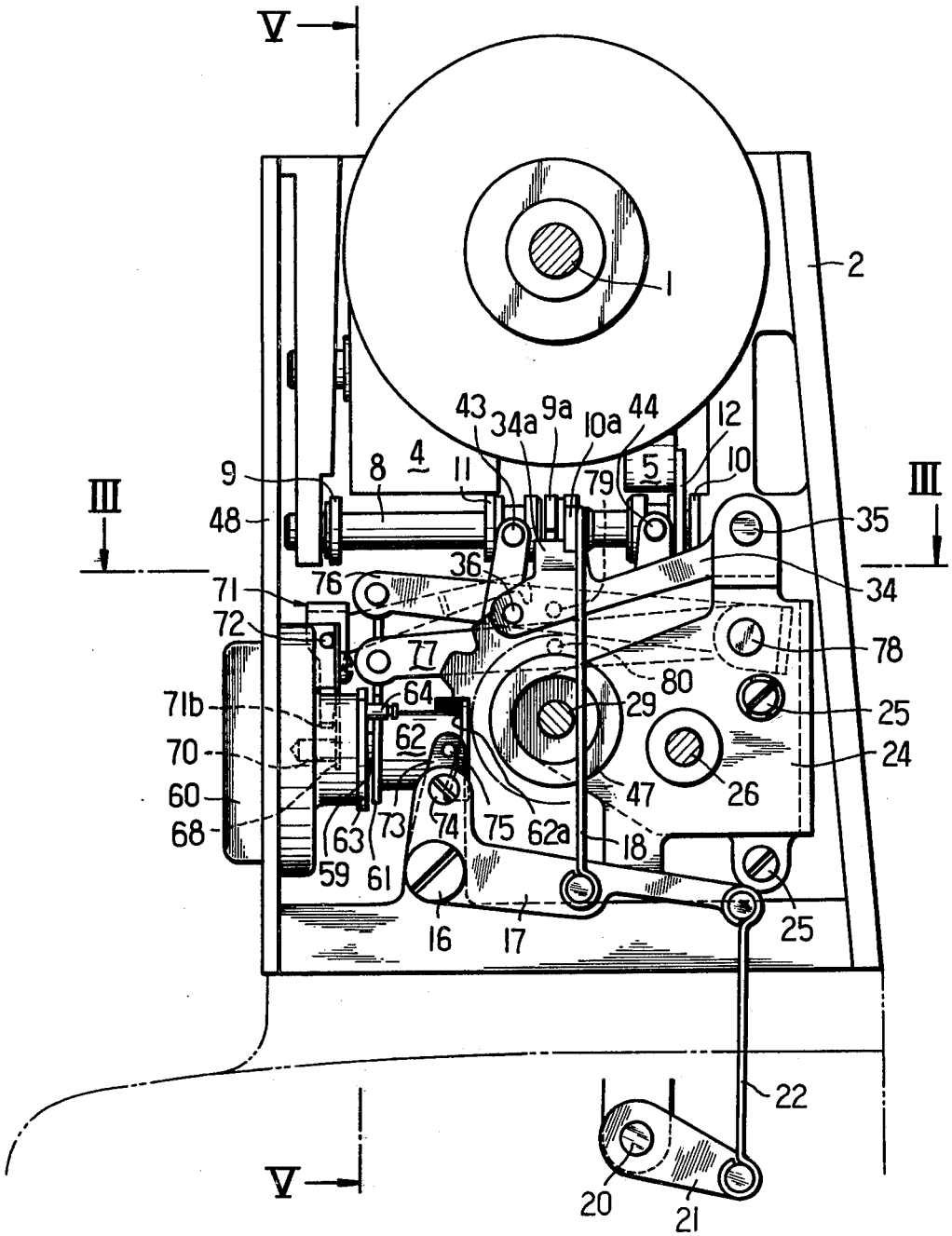
FIG. 2 is a side elevational view of the sewing machine with the side cover and a handwheel being removed.

The first rocker arm 9 is operatively connected to a well-known oscillating arm 84 through the intermediary of a connecting rod 15, the rocking movement of said first rocker arm is transferred to a needle bar 86 through a needle bar connecting rod 85 which is connected to a needle bar supporting frame (not shown because of it being well-known), a connecting head 85*a* of which rod 85 being engaged with the engaging surface 84*a* of the oscillating arm 84; in this way a predetermined lateral ocsillating movement is to be imparted to the needle bar 86. An action of a spring anchored between the needle bar supporting frame and the machine frame for biasing the supporting frame toward one direction is adapted to impart to said first rocker arm 9 a clockwise rotative force shown in FIG. 5 which leads to a pressing contact of the cam follower 11 upon the pattern cam 4. The second rocker arm 10 is, as shown in FIGS. 2 and 6, at the extension 10*a* thereof connected by a rod 18 to a feed controlling lever 17, which is rotatably mounted with a stepped screw 16 on the machine frame. The lever 17 is, through a rod 22, connected to a connecting arm 21 which is secured to one end of a feed controlling shaft 20. Said shaft is rotatably carried by the machine frame with the other end thereof being secured to a feed controlling member 19. A coil spring 23, for imparting to the feed controlling shaft 20 a clockwise rotative force in FIG. 2, is adapted to give the second rocker arm 10 a clockwise rotative force, which results in biasing all the time the second cam follower 12 to bear against the feed controlling cams 5.

Now the cam selecting means will be described herein. On a bracket 24, which is fixed to the machine frame 2 with a screw 25, is rotatably supported an operating shaft 26, on the outer end of which is attached a manually operated member 27 projecting outside of the side cover 28. In parallel with the bracket 24 in a shaft of, on which shaft is fitted a lift cam 30 (refer to FIG. 7) therethrough, which unitedly effects a rotative movement with said lift cam 30 has a gear portion 31 integrally formed thereon which is in mesh with a gear 32 secured on the operating shaft 26. A selector cam 33 is fitted, in abutment with the lift cam 30, to the supporting shaft 29 for unitedly rotating therewith, on which cam are formed respectively a first cam surface 33*a* for selecting the pattern cam 4 and a second cam surface 33*b* for selecting the feed controlling cam 5 (refer to FIG. 8). A release lever 34 is pivoted with a stepped screw 35 to the bracket 24 and normally bears against the surface of the lift cam 30 with a contact pin 36 secured to the tip thereof due to the action of a coil spring 37; on the upper edge of the release lever 34 is formed an engaging portion 34*a* for confronting from underneath each extention 9*a*, 10*a* of the first and second rocker arms 9 and 10, which engaging portion 34*a* is adapted to engage with both extentions 9*a* and 10*a* if the lever 34 is rotated against the action of the coil spring 37.

First and second shift levers 38 and 39 are rotatably mounted with stepped screws 40 and 41 respectively onto the bracket 24; the former 38 is provided with a contact pin 42 secured at an intermediate portion of the ends thereof for engaging with the first cam surface 33*a* of the selector cam 33 and also a pin 43 on the tip thereof for fitting in an annular groove 11a formed in the base portion of the first cam follower 11; the latter lever 39 is provided with a contact head 39*a* formed at an intermediate portion of the ends thereof for engaging with the second cam surface 33*b* of the selector cam 33 and also a pin 44 on the tip thereof for fitting in an annular groove 12*a* formed in the base portion of the second cam follower 12. A tension spring 45 is anchored between the first and the second shift levers 38, 39 such that the contact pin 42 and the contact head 39*a* respectively bear against the first cam surface 33*a* and the second cam surface 33*b*.

Figure 5:
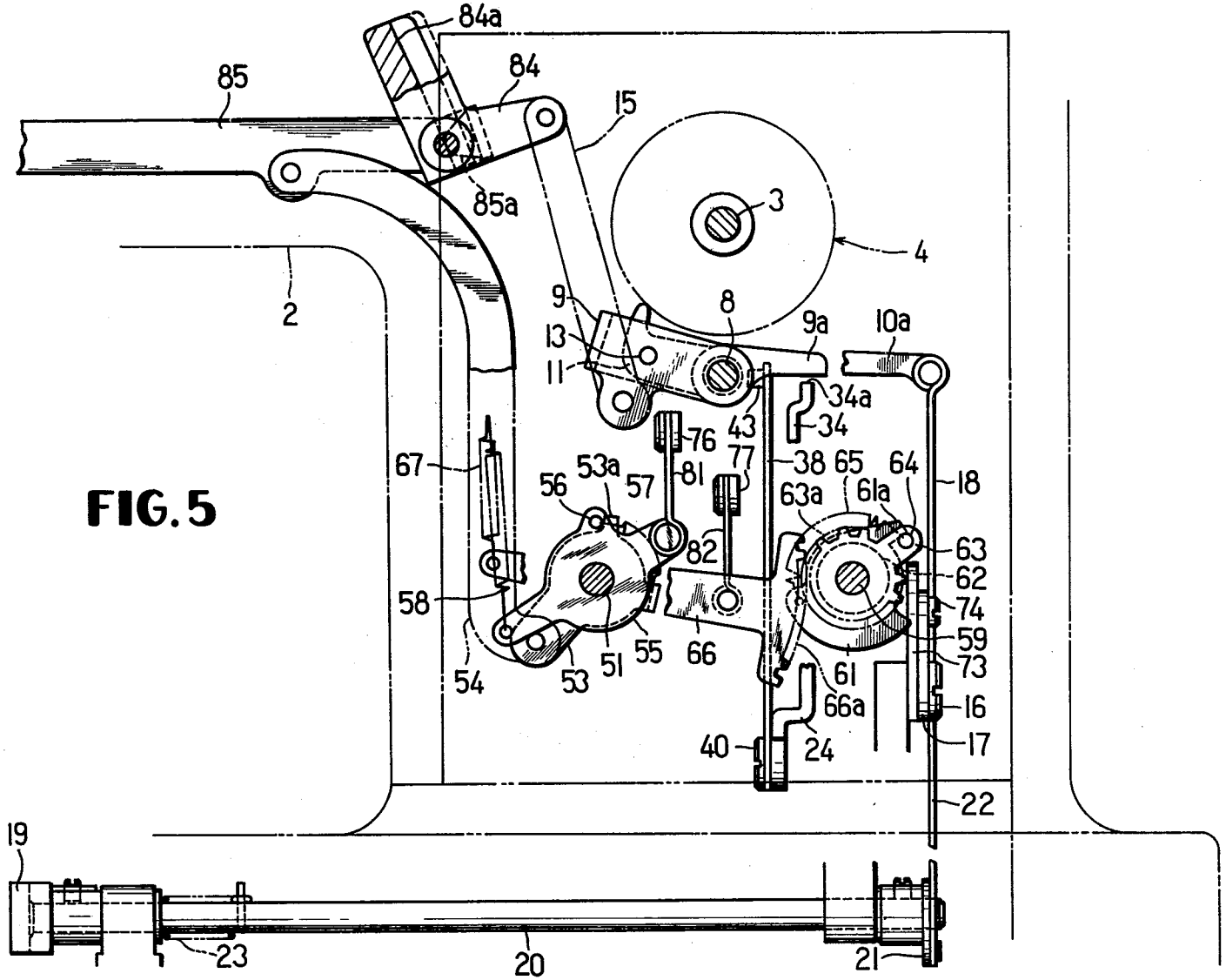
FIG. 5 is a vertical cross-sectional view taken substantially along the line V—V of FIG. 2.

When the manually operated member 27 is actuated to rotate, the lift cam 30 and the selector cam 33 are consequently rotated, and through an action of the release lever 34 the first and second rocker arms 9, 10 are rotated in the counterclockwise direction in FIGS. 5 and 6 to initially effect the separation of the first and second cam followers 11, 12 from the pattern cams 4 and the feed controlling cams 5, respectively; and in turn by means of an action of the first and second shift levers 38, 39 the first and second cam followers 11, 12 are independently moved along the stationary shaft 8 to be able to select any one of their cams, respectively.

The cam selecting means in this instance may not need any further description because of its having been familiar to those in the art.

Furthermore, on said supporting shaft 29 is fixedly carried a control cam 46 adjacent the selector cam 33 for unitedly rotating with the shaft 29. On cam 46 are formed a first and second cam grooves 46*a* and 46*b*, each having a later described function and a third cam surface 46*c*. A cylindrical member 47, secured onto the supporting shaft 29, functions to interconnect a pointer 50, and the supporting shaft 29, in order to shift the ponter 50 which indicates a stitch pattern corresponding to a selected cam in cooperation with the pattern indicator plate 49 disposed on the auxiliary plate 48, as shown in FIG. 1.

Members mounted on auxiliary plate 48 will now be described hereinunder. A first shaft 51 is rotatably carried by auxiliary plate 48; on the front of said plate is positioned a first manually operated knob 52 which is fixed to the outer end of the shaft 51; a regulating plate 53 is fixed to the inner extreme position of shaft 51 so as to be integrally turned therewith, one end of which regulating plate is, through the intermediary of a connecting rod 54, operatively connected to said needle-bar-connecting-rod 85 and serves to change the position of contactng head 85a of needle-bar-connecting-rod 85 to the rocking fulcrum of oscillating arm 84. The amplitude regulator is thus constructed of said regulating plate 53, connecting rod 54, oscillating arm 84, etc. An actuating arm 55 is loosely fitted to said shaft 51, and a tension spring 57, which is anchored between a pin 56 secured to said actuating arm 55 and said regulating plate 53, normally acts in a manner such that an abutting portion 53*a* formed on said regulating plate 53 is maintained to contact against said pin 56. A tension spring 58 is anchored between said actuating arm 55 and auxiliary plate 48 to impart to the former a torque in the clockwise direction as in FIG. 5 and consequently to bias said manually operated knob 52 in the same direction together with regulating plate 53 and shaft 51.

A second shaft 59 is rotatably carried by said auxiliary plate 48; a second manually operated knob 60 is positioned on the front of auxiliary plate 48 to be secured to the outer end of said shaft 59; a regulating plate 61 as well as a feed regulating cam body 62 are fixed to shaft 59 so as to be unitedly rotated with said manually operated knob 60; on one side of said feed regulating cam body 62 is formed a cam surface 62*a* for setting the forward feed length. A rotating arm 63 is loosedly fitted to said second shaft 59 and provided with gear teeth on the periphery thereof; a tension spring 65 anchored between a pin 64 mounted on said arm 63 and said regulating plate 61 always acts to maintain an abutting portion 61*a* formed on said regulating plate 61 contacting against said pin 64. A rack plate 66 is loosely carried by said shaft 51, having a rack portion 66*a* on the front end thereof for meshing with the gear teeth of said rotating arm 63; a tension spring 67 anchored between rack plate 66 and auxiliary plate 48 imparts to the former a clockwise torque, which resulting in biasing counterclockwise, as seen in FIG. 5, the manually operated knob 60 in cooperation with rotating arm 63, regulating plate 61, and feed regulating cam body 62.

Figure 4:
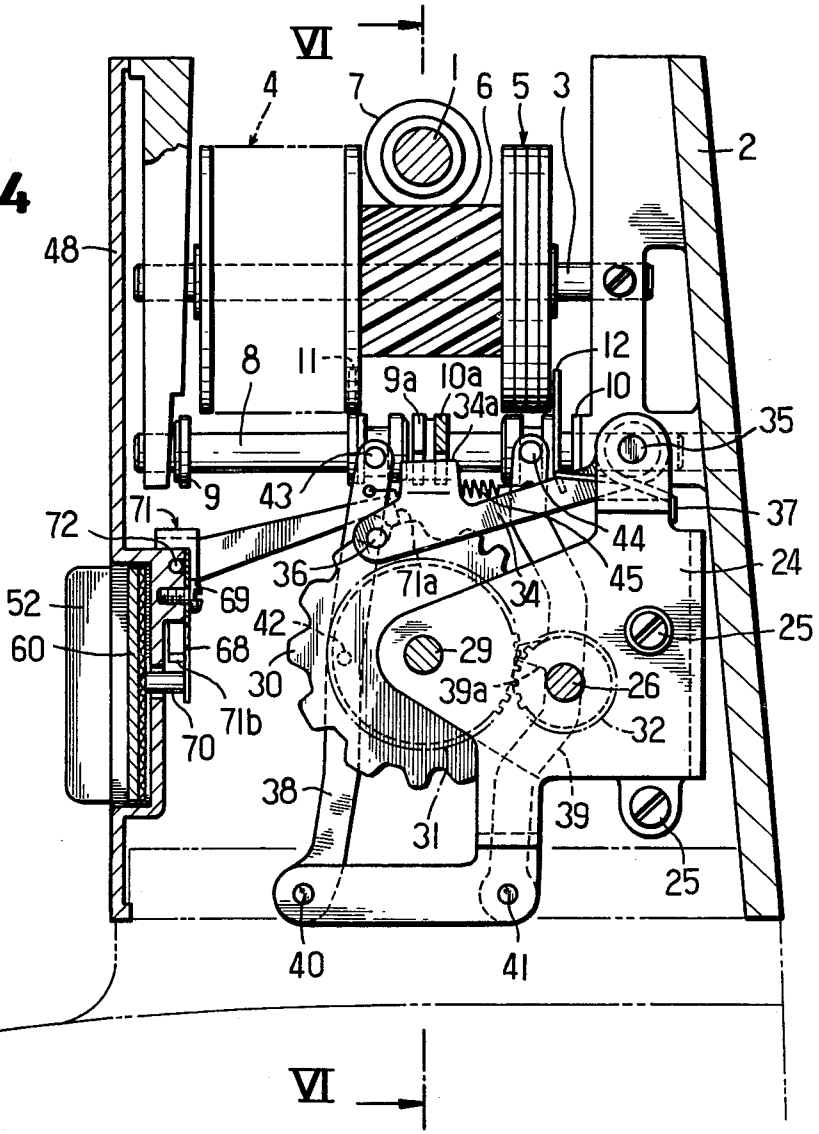
FIG. 4 is a vertical cross-sectional view taken substantially along the line IV—IV of FIG. 3.
Figure 3:
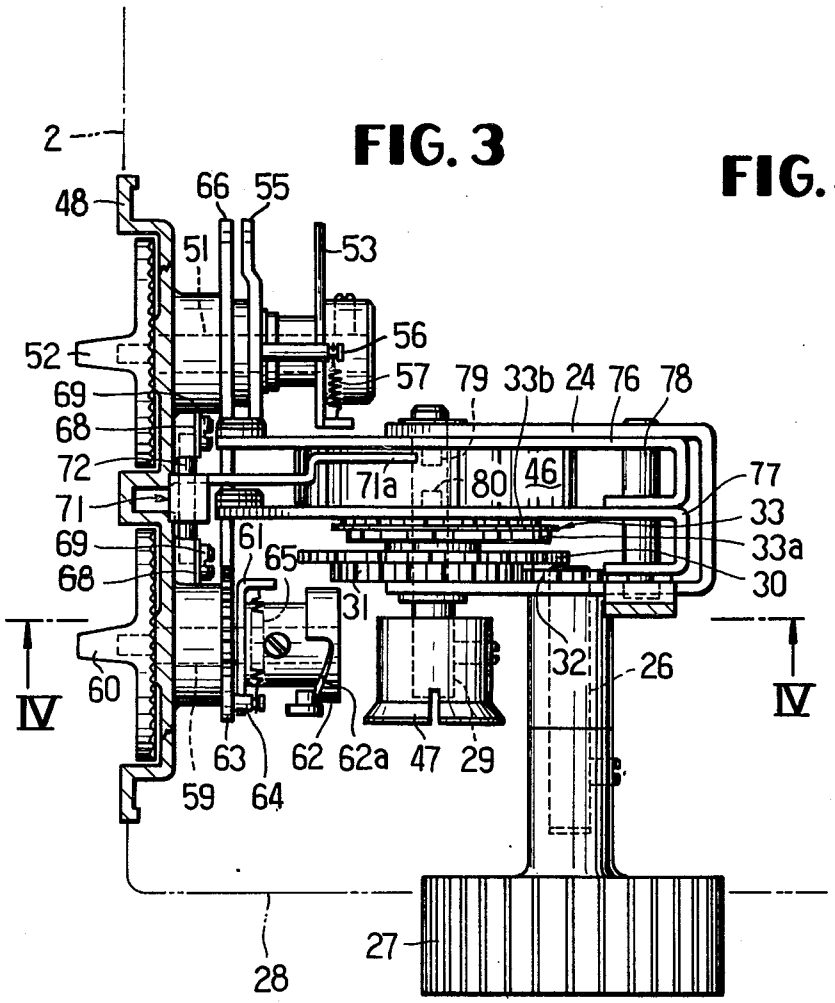
FIG. 3 is a transverse cross-sectional view taken substantially along the line III—III of FIG. 2 with the machine frame being omitted.

A pair of plate springs 68, 68 are respectively, referring to FIGS. 2 through 4, secured to the back of said auxiliary plate 48 with a screw 69. On each tip of said plate spring is fixed a frictionally engaging pin 70; these pins 70 penetrate through the auxiliary plate to engage with surfaces (refer to FIG. 4) formed on the back of said manually operated knobs 52, 60. Such engagement enables the knobs to be kept (or retained) at any desired rotative position against the action of said tension springs 58 and 67. A notch plate 71 is rotatably carried by a shaft 72 which is fixed with plate springs 68, 68; a tip 71a of an arm of plate 71 is engaged with a third cam surface 46*c* of said control cam 46; and tips of a pair of depended arms 71*b*, 71*b* are confronting said pair of plate springs 68, 68. When the notch plate 71 is rotated in the counterclockwise direction, as in FIG. 2 and 4, due to the action of the third cam surface 46*c*, frictionally engaging pins 70, 70 are disengaged from said manually operating knobs 52, 60 because of the engagement between the tips of depending arms 71*b*, 71*b* and plate springs 68, 68, respectively.

Referring further to FIG. 2, a feed control arm 73 is rotatable around screw 16 carried by the machine frame 2 and fixed to said feed control lever 17 with a screw 74 for united rotation with said lever 17; on the tip of said feed control arm 73 is mounted an engaging pin 75 for confronting with the cam surface 62*a* of said feed regulating cam body 62; the engaging pin 75 can be engaged with cam surface 62*a* due to the clockwise biasing of feed control arm 73 accompanied by feed controlling lever 17 actuated by the action of said coil spring 23 as seen in FIGS. 5 and 6. As a result, when said second manually operated knob 60 is rotatively operated, the feed controlling shaft 20 will be rotated through the intermediary of feed regulating cam body 62, feed control arm 73, feed controlling lever 17, rod 22, and connecting arm 21, and consequently the setting position of feed regulating member 19 is changed eventually to ensure the imparted feed movement to the feed dog 87. The feed regulator is thus constructed of feed regulating member 19, feed controlling lever 17, feed control arm 73, feed regulating cam body 62, etc. And the operative connection of the feed regulating member 19 and the feed dog 87 is so well known that the illustration will be omitted.

Finally, an operative connection between the abovementioned selecting means and the amplitude regulator as well as the feed regulator will be illustrated. First and second connecting levers 76 and 77 are rotatably carried by said bracket 24 with a pivot 78. On an intermediate portion thereof are mounted contact pins 79 and 80 for fitting into first and second cam grooves 46*a* and 46*b* of said controlling cam 46, respectively.

Those connecting levers 76, 77 are at one end connected through rods 81 and 82 to actuating arm 55 and rack plate 66, respectively; consequently said first and second connecting levers 76 and 77 are usually imparted a counterclockwise torque by the action of tension springs 58 and 67; contact pins 79 and 80 are thereby bearing against the inner surface of said first cam groove 46*a* and second cam groove 46*b*, respectively. Reference numeral 83 in FIG. 1 designates a handwheel for manually driving the main shaft.

Now the operating function of the thus constructed automatic zigzag sewing machine will be illustrated in detail.

FIGS. 2 to 11 represent various conditions in which some patterns of straight stitching and normal zigzag stitching are performed. The first cam follower 11, as is presented in FIG. 4, bears against the zigzag standard cam located at the extreme right of the stitch pattern cams 4; the second cam follower 12 is, on the other hand, located at an inactive position having engagement with none of the feed controlling cams 5. As is clearly shown in FIGS. 5 and 11, regulating plate 53 has been rotated to the greatest possible extent in a counterclockwise direction and the connecting head 85*a* of needle-bar-connecting-rod 85 is in perfect alignment with the fulcrum of oscillating arm 84; feed regulating member 19 is maintained in a set position for "forward feed and middle stitch length", by engagement of the engaging pin 75 of feed control arm 73 with the cam surface 62*a* of feed regulating cam body 62. Under these conditions operation of machine will provide straight stitching with the middle stitch length.

If a straight stitching at a feed length different from the above-mentioned is required, only a rotative operated of second manually operating knob 60 will have to be done by which operation feed regulating cam body 62 is rotated, accompanied by regulating plate 61 and the feed movement imparted to feed dog 87 is changed, due to the change of the engagement position between engaging pin 75 of feed control arm 73 and cam surface 62*a*, and due to rotation of feed regulating member 19 together with feed controlling shaft 20, which is caused as above-stated by way of feed controlling lever 17, rod 22, and connecting arm 21.

Figure 11:
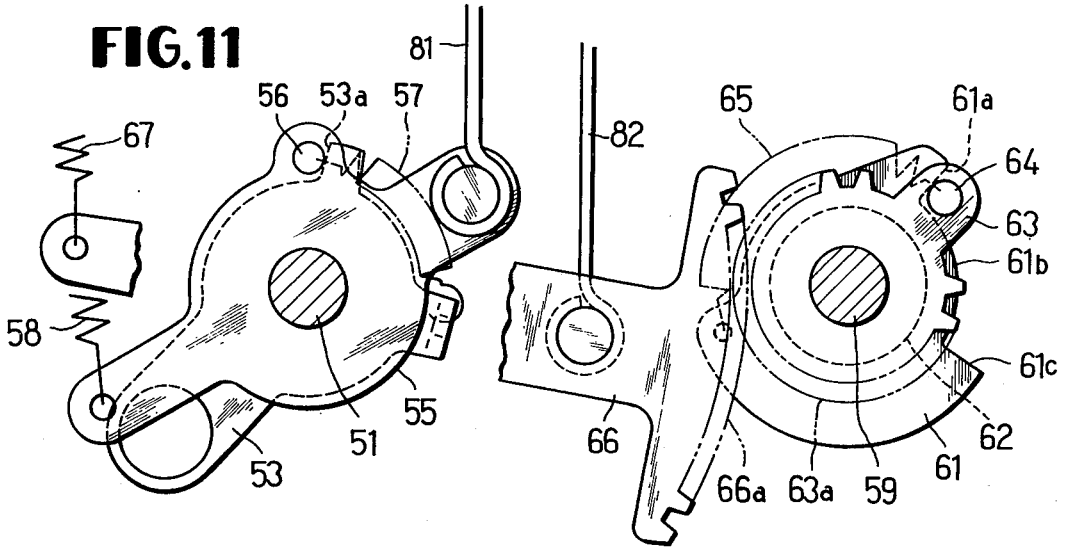
FIG. 11 is a view showing the relation of position of each member set when carrying out the straight stitch.

When the second manually operated knob 60 is rotated, for example, to the maximum extent in the direction to increase feed length from the state shown in FIGS. 5 and 11, regulating plate 61, together with feed regulating cam body 62, is clockwise (in the same Figures) rotated to the greatest extent. Although feed regulating body 19 is, as a result of it, set to be able to impart to feed dog 87 the movement for maximum feed length, rotating arm 63 is also simultaneously turned in the same direction, due to abutting contact relation between pin 64 and contact portion 61*a* of said regulating plate 61, to rotate in turn counterclockwise rack plate 66 about the first shaft 51. As a result the second connecting lever 77 is through rod 82 clockwise rotated in FIG. 2 to lift said contact pin 80; since cam groove 46*b* is, however, so formed as the width thereof allows contact pin 80 to shift freely, as shown in FIG. 9, there can be no interference at all within the width.

Figure 12:
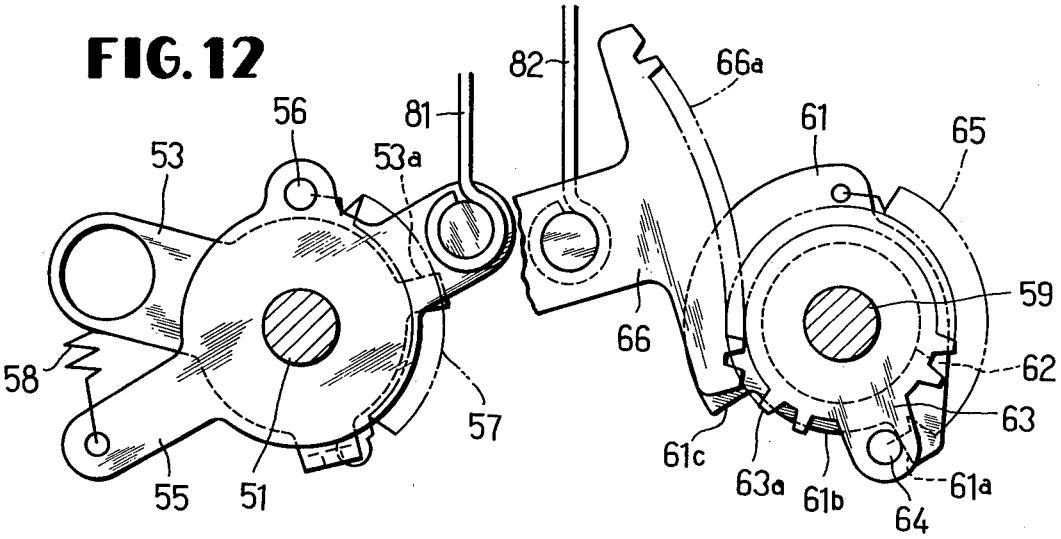

The position of regulating plate 61, rotating arm 63, and rack plate 66 in FIG. 12 represents the condition wherein feed length is, as above-mentioned, set at maximum; second manually operated knob 60 is retained in the rotated position against the action of tension spring 69 due to engagement between one of the knurled grooves impressed on the back thereof and frictionally engaging pin 70.

The rotation of feed controlling lever 17 turns through rod 18 second rocker arm 10, but second cam follower 12 can not prevent the engagement between engaging pin 75 of said feed control arm 73 and cam surface 62a of said feed regulating cam body 62, because cam follower 12 is not in engagement with any of the feed controlling cams 5. When, therefore, second manually operating knob 60 is rotatively operated in order to make the feed length smaller from the state shown in FIGS. 5 and 11, rotating arm 63 can not be turned because of presence of notch portion 61b, but regulating plate 61 is counterclockwise rotated against the action of tension spring 65, as in the same Figures, accompanied by feed regulating cam body 62; and feed regulating member 19 is then set at a state for small feed length. The construction in this instance is such that the feed length of said feed regulating member 19 is set at no feed at the state where the other contacting portion 61*c* shown in FIG. 11 is contacting the pin 64. In this case rotating arm 63 tends to turn due to the action of tension spring 65, but rack plate 66 can not rotate in the clockwise direction because of contact of pin 80 on said second connecting lever 77 into the inner surface of second cam groove 46*b* on control cam 46, which consequently retains rotating arm 63 at the same position.

That the second manually operated knob 60 which has been rotatively operated is retained against the action of tension spring 65 at the position different from the original position is, in this case also just like the abovementioned, an attribute to the action of the frictional engaging pin 70. The preset feed length in straight stitching can be, in this way, changed at will by means of rotative operation of the second manually operating knob 60 in the range from zero to maximum.

In performing a zigzag stitching, by rotatively operated first manually operating knob 52 only any desired amplitude of zigzag stitching can be obtained; that is to say, FIGS. 5 to 11 represent a state where the zigzag amplitude is, by the action of the first cam surface 46*a* of control cam 46, shown in FIG. 10, set at zero; if the first manually operated knob 52 is clockwise (in FIG. 1) rotated from this state, regulating plate 53 is rotated in the same direction, and in turn, contacting head 85*a* of needle-bar-connecting-rod 85 is shifted through the medium of connecting rod 54 to a different position from the fulcrum center of oscillating arm 84. When a machine is started, consequently, and when said oscillating arm 84 is oscillated by the oscillation of cam of the pattern cams 4 follower 11 which is engaged with a zigzag standard cam, the oscillation movement depending on the position of said contacting head 85*a* will be transferred through needle-bar-connecting-rod 85 to the needle bar supporting frame, resulting in giving a lateral oscillation movement to the needle bar. The position of regulating plate 53 in FIG. 12 corresponds with a state of a setting at maximum amplitude, wherein said first manually operated knob 52, just like said second manually operating knob 60, is retained at any required position of rotation aginst the action of tension spring 57, with the aid of frictional engaging pin 70 which is arrested by the knurling surface impressed on the back of the knob by the action of plate spring 68. The actuating arm 55 also tends to rotate by the action of tension spring 58 when regulating plate 53 has been clockwise rotated from the position shown in FIG. 11, but is forced to remain at the original position, because first connecting lever 76 is being prevented from shifting due to fitting of pin 79 thereon into first cam groove 46a of control cam 46 (refer to FIG. 10).

To sum up the above description, when manually operated member 27 is rotatively operated in order to perform a straight stitching or a normal zigzag stitching and when first cam follower 11 is engaged with the zigzag standard cam 4, second cam follower 12 is then engaged with none of feed controlling cams 5, the amplitude is set at zero, and feed length is set at middle length (e.g. 2) (refer to FIG. 11), therefore, when the machine is run the straight stitching is performed at middle stitch length; and a rotative operation of second manually operated knob 60 can at will change the feed length from zero to maximum, allowing a straight stitching at that feed length to be selected; and a rotative operation of first manually operated knob 52 makes possible a zigzag stitching at any amplitude from zero to maximum; accordingly, by means of rotative operation of both knobs 52 and 60 a zigzag stitching of any desired amplitude and feed length can be obtained. FIG. 12 represents a condition set at maximum amplitude (e.g. 5) and maximum feed length (e.g. 4).

A description on formation of A type stitch pattern shown in FIG. 15 wil be deployed herewith. When manually operated member 27 is rotatively operated such that the pointer 50 exactly comes to align with a representation corresponding to the stitch pattern A indicated on the pattern indicator plate 49, said operation actuates lift cam 30, selector cam 33, and control cam 46 together with supporting shaft 29 to rotate; the action of lift cam 30 and selector cam 33 causes first cam 4 follower 11 to engage with the pattern cam 4 corresponding to said stitch pattern A while allowing second cam follower 12 to remain at the inactive position.

On the other hand, rotative movement of said control cam 46 counterclockwise rotates notch plate 71 about the shaft 72 in FIG. 4 through engagement of the tip thereof 71*a* with a projecting portion of third cam surface 46*c* (refer to FIG. 9) and shifts frictional engaging pin 70 toward right in FIG. 9, through engagement of the tip of depending arm 71*b* with plate spring 68, against the action of the latter; as a result of it, said first and second manually operated knobs 52 and 60 will be, even if both have been rotatively operated to any desired position during said straight stitching or zigzag stitching (for example, position corresponding to the state shown in FIG. 12), rotatively returned once to a position corresponding to the state shown in FIG. 11 by the action of tension spring 58 and also tension spring 67 and 65, i.e., automatically reset; and thereafter will be returned to a fresh position to be set. In other words, first and second connecting levers 76 and 77 are rotated about the pivot 78 through engagement between contact pins thereof 79 and 80 and first and second cam groove 46*a* and 46*b* of control cam 46, respectively, for turning the actuating arm 55 and rack plate 66 about the shaft 51 through rods 81 and 82, respectively. Since these rotations always take place while said frictionally engaging pins 70 are isolated from said first and second manually operating knobs 52 and 60, regulating plate 53 is, accompanied by first manually operated knob 52, unitedly rotated with said actuating arm 55; and regulating plate 61, feed regulating cam body 62, and second manually operated knob 60, are rotated, accompanied by rotating arm 63 which is turned by said rack plate 66, unitedly therewith.

Accordingly, when a pattern cam corresponding to a desired stitch pattern, e.g., A, has been selected by rotative operation of said manually operated member 27, regulating plate 53 and feed rgulating cam body 62 shall be positioned at a state set by the inner surface of first and second cam grooves 46*a* and 46*b* of said control cam 46; that is, when a pattern cam corresponding to said stitch pattern A has been selected, contact pins 79 and 80 of first and second connecting levers 76 and 77 will be respectively engaged with the inner surfaces, at the position $P_1$ shown in FIGS. 9 and 10, of first and second cam grooves 46*a* and 46*b*, with the positions of regulating plate 53 and feed regulating cam body 62 being respectively set at maximum amplitude (e.g. 5) and middle feed length (e.g. 2); and the amplitude and feed length thus set are to be indicated on the front side of said auxiliary plate 48 by automatic movement of said first and second manually operated knobs 52 and 60; and because of engagement of the tip 71a of notch plate 71 at that position with the bottom of third cam surface 46c, frictional engaging pins 70, 70 respectively engage with the knurling on the back of said first and second knobs 52 and 60 by the action of plate springs 68, 68.

When a machine is worked in this state, oscillating arm 84 oscillates in response to the shape of a selected pattern cam to form a desired stitch pattern A responding to an amplitude and a feed length to be set. When set amplitude and feed length are required to be changed, however, mere appropriate rotataive operation of first and/or second manually operated knobs 52 and/or 60 is, in likewise as the above-mentioned, all one has to do. In this case, if first manually operated knob 52 is rotated in the amplitude-reducing direction, first connecting lever 76 is lifted through the intermediary of rod 81 because actuating arm 55 is, due to an abutting contact of contact portion 53*a* of regulating plate 53 and pin 56, forced to rotate counterclockwise. The rotation of connecting lever 76 against the action of tension spring 58 is to be interfered by the abutting of contact pin 79 against the outer surface at $P_1$ position of first cam groove 46*a*. The possible range of amplitude changing in this instance is, therefore, limited from the maximum amplitude 5 to minimum amplitude 1. As second connecting lever 77 is retained against rotation by contact pin 80 at the $P_1$ position of second cam groove 46b, rack plate 66 and rotating arm 63 are prevented from turning and the possible range of rotation for second manually operated knob 60 is limited by the engagement between pin 64 and abutting portions 61*a*, 61*c* of regulating plate 61. The possible range of changing feed length is consequently limited in this instance from 2 to 0, and it can not be increased to more than 2.

Then, when manually operated member 27 is rotatively operated similarly to the above-mentioned to form a stitch pattern B indicated in FIG. 15, first cam follower 11 is engaged with a cam corresponding to the pattern, second cam follower 12 will still remain, however, in an inactive position having no engagement with any one of feed controlling cams 5; and contact pins 79 and 80 of first and second connecting levers 76 and 77 are engaged with the inner surface at the position $P_2$ of first and second cam grooves 46*a* and 46*b* shown in FIGS. 9 and 10, which will lead to automatic setting of amplitude at the maximum 5 and of feed length of the fine feed length F. It will be easily understood from the above-mentioned, therefore, that the possible range of changing amplitude is from 5 to 3 and the possible range of changing feed length is from 0 to 2.

Figure 13:
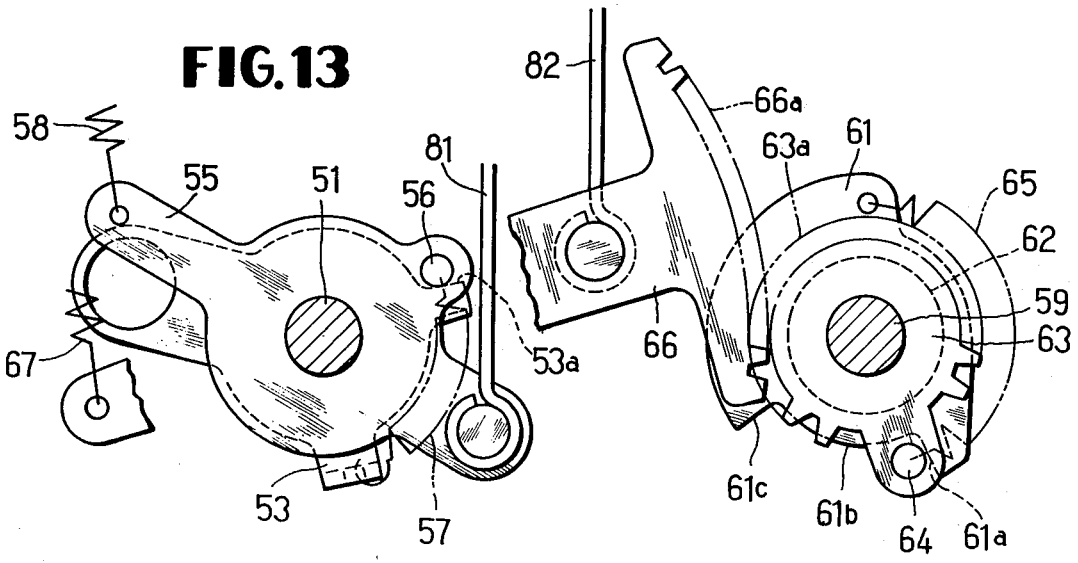

Furthermore, in case of rotative operation of manually operated member 27 with the object of forming a stitch pattern C shown in FIG. 15, first cam follower 11 is engaged with a cam corresponding to the pattern while second cam follower 12 is engaged with a feed control cam for forming the so-called stretch stitch; and contact pins 79 and 80 for fitting into first and second cam grooves 46*a* and 46*b* of said control cam 46 are respectively engaged therewith at the $P_3$ position. As a result of this, as shown in FIG. 13, regulating plate 53 is turned to a position for setting maximum amplitude 5 where connecting head 85*a* engaging with oscillating arm 84 has been shifted from the fulcrum center to the greatest extent, and regulating plate 61 is rotated together with feed regulating cam body 62 to a place for setting maximum feed length 4. At the same time first and second manually operated knobs 52 and 60 located on the front of the auxiliary plate 48 are respectively turned to indicate, in a similar way as aforementioned, said amplitude and feed length automatically set.

When a machine is worked in this condition a rocking movement corresponding to the shape of a selected pattern cam is, through first cam follower 11, first rocker arm 9, oscillating arm 84, needle-bar-connecting-rod 85, etc., delivered to the needle bar; on the other hand, a rotative movement corresponding to the shape of a feed control cam is, through second cam follower 12, second rocker arm 10, rod 18, feed controlling lever 17, rod 22, and connecting arm 21, transferred to the feed controlling shaft 20. And feed regulating member 19 is turned with said shaft 20 to impart a feed movement of so-called "two step forward — one step backward" type to the feeddog, by which a desired stitch C pattern is formed.

In this process feed regulating cam body 62 has been rotated for setting a maximum feed length, so that an abutment of engaging pin 75 of feed control arm 73 to the cam surface **62*a*** can not take place either.

If first manually operated knob 52 is rotatively operated against the action of plate spring 68, regulating plate 53 will be rotated in the counterclockwise (in FIG. 13) direction, resulting in forcibly turning actuating arm 55 against the action of tension spring 58, which enables the first manually operated knob 52 to be manually turned to a position, shown in FIG. 14, where contact pin 79 of first connecting lever 76 is being contacted in abutment with the outer surface at the $P_3$ position of first cam groove **46*a*; the possible range of changing amplitude in this case is from 5 to 3; the said knob 52 can be, therefore, operated to any desired position within the range and retained there by the action of plate spring 68 and frictional engaging pin 70. Feed regulating cam body 62 can also be rotated (refer to FIG. 14) for setting any desired feed length from maximum 4 to 1 by means of turning operation of second manually operated knob 60, which movement is possible because of existence of the notch portion 61b of regulating plate 61; however, feed regulating member 19** has nothing to do with the changing set of feed length because it is under control of the feed control cam.

If feed regulating cam body 62 should be turned to set the small feed length to cause the engaging pin 75 of feed regulating arm 73 to be interfered by cam surface **62*a*, the stitch pattern could be disturbed; so the machine shall be constructed such that regulating plate 61 is not allowed to counterclockwise rotate further from the position shown in FIG. 14 (e.g. the position of feed length 3.5). When manually operated member 27 is rotatively operated in order to perform aforementioned straight stitching after said stitch pattern C has been formed, pressed engagement between first and second manually operating knobs 52 and 60 and frictionally engaging pins 70, 70, is released immediately after the starting of rotation due to the engagement between a projection of third cam surface 46c of control cam 46 and notch plate 71; each member shown in FIG. 14 is to be restored or reset once to the position shown in FIG. 13 (both knobs are also respectively restored to the positions corresponding to those in FIG. 13); therefore, when first cam follower 11 is engaged with the standard zigzag cam and second cam follower 12 is shifted to the inactive position owing to the action of first and second cam groove 46*a* and 46*b* of control cam 46, said each member is shifted to the position shown in FIG. 11 for causing amplitude to be automatically set at 0 and feed length at middle length. The first and second knobs 52 and 60** are respectively turned to the positions corresponding to the set amounts to indicate the same.

As this embodiment has clearly proved the zigzag sewing machine in accordance with the present invention is constructed such that, by the rotation of control cam 46 being interlocked with manually operated member 27 which is to be operated in forming a desired stitch pattern for selecting a cam corresponding to the desired pattern, and by the action of first and second cam surface **46*a* and 46*b*** formed on said control cam, a combination of most frequently used amplitude and/or feed length suitable for the desired stitch pattern, is automatically set, and such that intricacies in using and operating accompanied by the conventional machines which need such amplitude and/or feed length as suitable for a desired stitch pattern to be set each time by means of operating knobs have completely been eliminated.

And this sewing machine allows, on occasion, said automatically set amplitude and feed length to be appropriately changed by means of manually operated knobs 52 and 60, which could fully satisfy skilful users of sewing machines. Furthermore, the possible range of change in manually set amplitude and feed length aforementioned can be determined at will depending on the width of first and second cam grooves **46*a* and 46*b* or the width of notch portion 61*b* of regulating plate 61**, which prevents the changing from being improperly carried out.

The third cam surface **46*c* is provided with an even portion 46D, as can be seen in FIG. 9, which is for, in performing a button hole stitching, more particularly, in forming darning portions on right and left sides thereof or barring portions on upper and lower sides thereof, preventing difference of amplitude from taking place between said darning portions or between said barring portions, that is to say, for retaining the manually adjusted and set amplitude intact throughout the button hole stitching process. Due to the even portion of the third cam surface the notch plate 71 does not operate and serves to retain the first manually operating knob 52** at the manually rotated position.

Although the same pattern cam (zigzag standard cam) is, in the above-mentioned embodiment, being employed in both straight stitching and zigzag stitching, it would be more convenient and more effective to permit use of a particular cam for straight stitching (in practice, a circular plate having the outer periphery with an equal radius), that is, (a) when said zigzag standard cam has been selected a zigzag stitching could be executed at an automatical set of, for example, amplitude 2 and feed length 2, and (b) when said circular cam has been selected a straight stitching could be executed at an automatical set of, for example, amplitude 0 and feed length 2. It is quite apparent from what has been described above that construction of sewing machines of such a type is feasible.

It will be obvious to those skilled in the art that various changes may be made without departing from the scope of the invention and the invention is not to be considered limited to what is shown in the drawing and described in the specification.

What is claimed is:

1. A zigzag sewing machine, comprising:

a frame, stitch forming instrumentalities mounted on the frame, a plurality of stitch pattern information carrying means for controlling said instrumentalities and for forming a plurality of different stitch patterns, pattern selecting means operative to render one of said stitch pattern information carrying means corresponding to a desired stitch pattern selectively effective, regulators for influencing said stitch forming instrumentalities and for controlling amplitude and feed length and direction, at least one manually operable knob operatively connected with said regulators, and connecting means operatively connecting said pattern selecting means with at least one of said regulators for automatic setting thereof into a predetermined condition suitable to form the desired stitch pattern in relation to the operation of said pattern selecting means, said manually operable knob operatively connected with said at least one regulator being adapted to be automatically shifted to a position corresponding to the automatic setting of said regulator for indicating said setting thereof, and being adapted to be optionally shiftable from said position to another position within a certain range for changing said setting of said at least one regulator, independently of the operation of said pattern selecting means.

2. A zigzag sewing machine according to claim 1, further comprising:

means for holding the manually operable knob in said another position, and means for releasing the action of said holding means upon the operation of said pattern selecting means.

3. A zigzag machine according to claim 2, wherein said pattern selecting means includes a single manually operable member for selecting a desired stitch pattern, and said connecting means includes control cam means movably mounted in the frame, for movement in relation to the operation of said single manually operable member, and control linkage means operatively interconnecting said control cam means with at least one of said regulators.

4. A zigzag sewing machine, comprising:

a frame, a needle bar carried by said frame for lateral oscillation and for lengthwise reciprocation, a feed dog movably mounted in cooperation with said needle bar, a main shaft rotatably mounted on the frame for actuating said needle bar and feed dog, a plurality of stitch pattern cams rotatably carried by the frame and driven in timed-relation to the rotation of said main shaft, first cam follower means mounted for engaging with a selected one of said stitch pattern cams and for imparting lateral oscillation according to the cam shape to said needle bar, at least one feed controlling cam rotatably carried by the frame and driven in timed-relation to rotation of the main shaft, second cam follower means mounted for selectively engaging with said feed controlling cam and for controlling the feed movement of said feed dog according to the cam shape, cam selecting means operable for selectively engaging said first and second cam follower means with one of said stitch pattern cams and said feed controlling cam, respectively, corresponding to a desired stitch pattern, an amplitude regulator for regulating the amplitude of lateral oscillation imparted to the needle bar, a first manually operable knob operatively connected with the amplitude regulator for operation thereof, a feed regulator for regulating the length and direction of feed movement of the feed dog, a second manually operable knob operatively connected with the feed regulator for operation thereof, and connecting means operatively connecting said cam selecting means with said amplitude regulator and said feed regulator for automatically setting them into a predetermined condition suitable to form the desired stitch pattern in relation to the operation of said cam selecting means, wherein each of said first and second knobs are adapted to be automatically shifted to a position corresponding to each setting of said regulators, respectively, for indicating the amplitude of lateral oscillation and the length of feed movement automatically determined upon said operation of the cam selecting means, and wherein said feed regulator is controlled according to the cam shape of said feed controlling cam in the automatically shifted position of said second knob upon engagement of said second cam follower means with said feed controlling cam by the operation of said cam selecting means.

5. A zigzag sewing machine, comprising:

a frame, a needle bar carried by said frame for lateral oscillation and for lengthwise reciprocation, a main shaft rotatably mounted on the frame to actuate said needle bar for the lengthwise reciprocation, a plurality of stitch pattern information carrying means for controlling the lateral oscillation of said needle bar to form a plurality of different stitch patterns, operating means operatively connected to said needle bar for imparting thereto the lateral oscillation according to said stitch pattern information carrying means, pattern selecting means operative to render one group of said stitch pattern information carrying means corresponding to a desired stitch pattern selectively effective, an amplitude regulator operatively interconnected with said operating means for regulating the amplitude of lateral oscillation imparted to said needle bar, connecting means operatively connecting said pattern selecting means with said amplitude regulator for automatic setting thereof into a predetermined condition suitable to form a desired stitch pattern in relation to the operation of said pattern selecting means, manual means operatively connected with said amplitude regulator, said manual means being shiftable for changing the setting of the regulator into another condition from said predetermined condition independently of the operation of said pattern selecting means, means for holding said manual means in the shifted position thereof, and means for releasing the action of said holding means upon the operation of said pattern selecting means.

6. A zigzag sewing machine according to claim 5, wherein said stitch pattern information carrying means comprises a plurality of stitch pattern cams rotatably mounted on said frame and driven in timed-relation to the rotation of said main shaft, said operating means includes cam follower means mounted for engagement with one of said stitch pattern cams, and said pattern selecting means is operative to engage said cam follower means with a selected one of said stitch pattern cams corresponding to a desired stitch pattern.

7. A zigzag sewing machine according to claim 5, wherein said manual means includes a manually operable knob adapted to be automatically shifted to a position corresponding to the setting of said amplitude regulator, in the predetermined condition thereof, for indicating the amplitude of lateral oscillation automatically determined.

8. A zigzag sewing machine, comprising:

a frame, a needle bar carried by said frame for lateral oscillation and for lengthwise reciprocation, a main shaft rotatably mounted on the frame to actuate said needle bar for the lengthwise reciprocation, a plurality of stitch pattern information carrying means for controlling the lateral oscillation of said needle bar to form a plurality of different stitch patterns, operating means operatively connected to said needle bar for imparting thereto the lateral oscillation according to said stitch pattern information carrying means, pattern selecting means operative to render one group of said stitch pattern information carrying means corresponding to a desired stitch pattern selectively effective, a feed dog movably mounted on said frame and actuated by said main shaft in cooperation with said needle bar, a feed regulator for regulating the length and direction of feed movement of said feed dog, connecting means operatively connecting said pattern selecting means with said feed regulator for automatic setting thereof into a predetermined condition suitable to form a desired stitch pattern in relation to the operation of said pattern selecting means, manual means operatively connected with said feed regulator, said manual means being shiftable for changing the setting of the regulator into another condition from said predetermined condition independently of the operation of said pattern selecting means, means for holding said manual means in the shifted position thereof, and means for releasing the action of said holding means upon the operation of said pattern selecting means.

9. A zigzag sewing machine according to claim 8, wherein said manual means includes a manually operable knob adapted to be automatically shifted to a position corresponding to the setting of said feed regulator, in the predetermined condition thereof, for indicating the length of feed movement automatically determined.

10. A zigzag sewing machine according to claim 8, wherein said pattern selecting means includes a single manually operable member rotatably mounted on said frame, said connecting means includes control cam means mounted in said frame for rotation in relation to the operation of said single manually operable member, and control linkage means operatively interconnecting said control cam means with said feed regulator, and said releasing means is operable in relation to said control cam means upon the manual operation of the single operable member.

11. A zigzag sewing machine, comprising:

a frame, a needle bar carried by said frame for lateral oscillation and for lengthwise reciprocation, a feed dog movably mounted in cooperation with said needle bar, a main shaft rotatably mounted on said frame for actuating said needle bar and said feed dog, a plurality of stitch pattern cams rotatably carried by said frame and driven in timed-relation to the rotation of said main shaft, cam follower means mounted for engagement with a selected one of said stitch pattern cams and for imparting lateral oscillation according to the cam shape to said needle bar, cam selecting means operable for selectively engaging said cam follower means with one of said stitch pattern cams corresponding to a desired stitch pattern, an amplitude regulator for regulating the amplitude of lateral oscillation imparted to said needle bar, a first manually operable knob operatively connected with said amplitude regulator for operation thereof, a feed regulator for regulating the length and direction of feed movement of said feed dog, a second manually operable knob operatively connected with said feed regulator for operation thereof, connecting means operatively connecting said cam selecting means with said amplitude regulator and said feed regulator for automatically setting them into a predetermined condition suitable to form the desired stitch pattern in relation to the operation of said cam selecting means, each of said first and second knobs being adapted to be automatically shifted to a position corresponding to each setting of said regulators, respectively, for indicating the amplitude of lateral oscillation and the length of feed movement automatically determined upon said operation of the cam selecting means, and being adapted to be optionally shiftable from said position to another position for changing said setting of each regulator independently of the operation of said cams selecting means, means for holding each of said first and second knobs in said another position, and means for releasing the action of said holding means in relation to the operation of said cam selecting means.

12. A zigzag sewing machine according to claim 11, therein said cam selecting means includes a single manually operable member rotatably mounted on said frame, said connecting means includes control cam means mounted in said frame for rotation in relation to the operation of said single manually operable member, and control linkage means operatively interconnecting said control cam means with said regulators, said control cam means has two cam grooves adapted to automatically set said each regulator into the predetermined condition by means of said linkage means, and each said regulator is changeable from the predetermined condition to another condition within a certain range depending on each said cam groove by the optional shifting of said manually operable knob.

* * * * *